US005730020A

United States Patent [19]

Sullivan

[11] Patent Number: 5,730,020

[45] Date of Patent: Mar. 24, 1998

[54] APPARATUS AND METHOD FOR STRAIGHTENING ARROWHEADS

[76] Inventor: John Louis Sullivan, S 2895 Twin Pine Rd., Reedsburg, Wis. 53959

[21] Appl. No.: 687,237

[22] Filed: Jul. 25, 1996

[51] Int. Cl.[6] ..... B21D 3/10

[52] U.S. Cl. ..... 72/388; 72/454

[58] Field of Search ..... 72/387, 388, 454

[56] References Cited

U.S. PATENT DOCUMENTS

| | | | |
|---|---|---|---|
| 6,997 | 3/1850 | Bex | 72/454 |
| 2,876,822 | 3/1959 | Groves | 153/39 |
| 2,954,814 | 10/1960 | Covy | 72/388 |
| 3,034,385 | 5/1962 | Hester | 81/15 |
| 3,154,982 | 11/1964 | McQueary | 81/15 |
| 3,388,575 | 6/1968 | Fuzere | 72/35 |
| 3,456,467 | 7/1969 | Hogarth | 72/32 |
| 3,464,180 | 9/1969 | Bond | 72/388 |
| 3,846,998 | 11/1974 | Lock | 72/34 |
| 3,859,728 | 1/1975 | Shutt | 33/180 R |
| 4,155,172 | 5/1979 | Bartol | 33/174 Q |
| 4,203,308 | 5/1980 | Davis | 72/34 |
| 4,623,410 | 11/1986 | Hillesheim et al. | 156/64 |
| 4,643,016 | 2/1987 | Barberine et al. | 72/388 |

*Primary Examiner*—David Jones

*Attorney, Agent, or Firm*—Kenyon & Kenyon

[57] ABSTRACT

An apparatus for straightening arrowheads is designed to be used to straighten bent arrowheads so that the arrowheads, once straightened, may later be used in archery activities. To straighten a bent arrowhead, one removes or retracts any blades of the arrowhead (if possible) and attaches the arrowhead to a rotatable shaft. The rotatable shaft is free to rotate through the shaft aperture in the shaft housing, and the shaft housing is attached to the base of the device. To straighten the arrowhead, one applies pressure to the high side of the tip end of the arrowhead and, if desired, rotates the rotatable shaft so that the pressure is evenly applied to the high side of the tip end. The apparatus employs a pressure screw and a pressure band to effectively apply pressure to the arrowhead. After one or more applications of pressure to the high side of the tip end of the arrowhead, the arrowhead is checked to ensure that the arrowhead has the desired amount of straightness and that it is suitable for use in archery activities. Because straightening bent arrowheads while one is "in the field" is often desirable, the apparatus is compact and easily transportable.

18 Claims, 3 Drawing Sheets

APPARATUS AND METHOD FOR STRAIGHTENING ARROWHEADS

FIELD OF THE INVENTION

The invention relates generally to the field of archery, and more particularly to an apparatus and method for straightening arrowheads.

BACKGROUND OF THE INVENTION

Numerous people enjoy the sport of archery regularly. The fundamental principle of archery is that archers use bows (or crossbows) to shoot arrows (or bolts) at targets. This principle remains the same whether an archer is hunting game in the field, practicing target shooting at home, or participating in an archery tournament or demonstration.

Arrows typically are composed of four parts: an arrow shaft, an arrowhead, a nock or notch, and fletchings. Arrow shafts used in archery are fabricated out of a variety of materials such as wood, metal, fiberglass, and graphite. Metallic arrow shafts, usually either stainless steel or aluminum, are by far the most popular type.

When an arrow with a metallic shaft is used, however, the shaft often bends when the arrow strikes a solid object, such as a rock, a target butt, or a piece of wood. A metallic shaft may also bend when an arrow ricochets off a target. Rather than disposing of arrows with bent shafts, however, straightening the bent shafts instead is often desirable.

Although bent arrow shafts can sometimes be straightened by hand, manual straightening usually lacks the precision necessary to obtain a shaft sufficiently straight for the level of accuracy and performance desired in archery shooting. Thus, many attempts have been made directed toward developing mechanisms for straightening arrow shafts. These attempts include U.S. Pat. No. 2,876,822 to Groves; U.S. Patent No. 3,034,385 to Hester; U.S. Pat. No. 3,154,982 to McQueary; U.S. Pat. No. 3,388,575 to Fuzere; U.S. Pat. No. 3,846,998 to Lock; U.S. Pat. No. 4,203,308 to Davis; and U.S. Pat. No. 4,623,410 to Hillesheim et al.

The above-listed prior art patents directed toward straightening arrow shafts, however, are not designed to be used to straighten bent arrowheads. Likewise, while other archery-related patents, such as U.S. Pat. No. 3,859,728 to Shutt (arrowhead setting device) and U.S. Pat. No. 4,155,172 to Bartol (arrow straightness gauge), do exist, they do not provide an apparatus or method that will straighten arrowheads with the necessary precision required.

There are generally four types of arrowheads used in the field of archery: arrowheads with fixed blades ("killer broadheads"); arrowheads with removable blades ("replaceable blade broadheads"); arrowheads with blades that open when the arrowhead strikes an object ("expanding broadheads"); and arrowheads without blades ("field tips" or "target tips"). All four of these arrowheads are usually constructed from steel or a lightweight metal (such as aluminum). Arrowheads can be described as having a tip end and a threaded attachment end, whereby the arrowhead is attached to an arrow shaft by screwing the threaded attachment end into the end of the arrow shaft.

When an arrowhead strikes a solid object, such as a rock, a target butt, or a piece of wood, the possibility always exists that the arrowhead may bend. An arrowhead may also bend when an arrow ricochets off a target. A bent arrowhead exhibits the characteristic of having a "high side." The high side of a bent arrowhead is that portion of the arrowhead that is bent away from an imaginary horizontal axis running through the center of the arrowhead when it is straight. If one applies pressure to the high side of a bent arrowhead, the bent portion of the arrowhead will be forced toward the horizontal axis.

A bent arrowhead inhibits the performance of the arrow to which the arrowhead is attached. When an arrowhead is bent, the flight path of the arrow will be adversely affected and the archer will not achieve the level of accuracy and performance desired. Thus, if an archer desires to maintain a peak level of performance when using a bow and arrows (or a crossbow and bolts), the archer must use only straight arrowheads.

Purchasing new arrowheads, though, can be an expensive endeavor. Thus, rather than disposing of bent arrowheads, many archers prefer to straighten bent arrowheads for later reuse.

Most archers who attempt to straighten out their bent arrowheads do so by hand. The process for manually straightening a bent arrowhead usually involves the archer securing the attachment end of the arrowhead to a fixed surface and striking the high side of the bent arrowhead tip with a tool, such as a hammer. The process is repeated until the arrowhead seems straight in the eyes of the archer. "By hand" straightening, however, usually lacks the precision necessary to obtain an arrowhead sufficiently straight for the level of accuracy and performance desired in archery shooting.

Archers also frequently have a need to straighten arrowheads while the archer is "in the field." For example, if a number of an archer's arrowheads become bent while the archer is out hunting or is attending an archery competition or demonstration, the archer may not have enough straight arrowheads left so that the archer can continue to participate in the activity. Furthermore, most "by hand" straightening methods employed by archers to straighten bent arrowheads are not easily performed while the archer is in the field.

SUMMARY OF THE INVENTION

In light of the above, it is an object of the present invention to provide an apparatus and method for straightening arrowheads. It is a further object of the present invention that an archer (or other person interested in straightening arrowheads) using the apparatus and/or method can quickly and accurately straighten bent arrowheads. It is an additional object of the present invention to provide an apparatus and method for straightening arrowheads that is easily used by archers despite whether the archer is at home or in the field.

Accordingly, it is an embodiment of the invention to provide an apparatus for straightening an arrowhead. The apparatus includes a shaft housing attached to a base. A rotatable shaft passes through an aperture in the shaft housing, and one end of the rotatable shaft has an arrowhead attachment cavity wherein an arrowhead in need of straightening is to be attached. A pressure screw is attached to the base and is used for applying pressure to the high side of the tip end of the arrowhead.

The apparatus also includes a metal pressure band that is connected to the base. A portion of the pressure band extends between the pressure screw and the arrowhead to be straightened. Although the rotatable shaft normally is laterally moveable through the aperture in the shaft housing, a lock ring restricts the lateral mobility of the rotatable shaft when the lock ring is secured to the rotatable shaft with a set screw.

A method for straightening an arrowhead includes securing an arrowhead in need of straightening to an end of a rotatable shaft and determining the high side of the tip end of the arrowhead. The position of the rotatable shaft is adjusted so that the high side of the tip end of the arrowhead is in the path of a means for applying pressure, and then pressure is applied to the high side of the tip end of the arrowhead. The method also includes rotating the rotatable shaft while pressure is applied to the arrowhead and interposing a pressure band between the arrowhead and the means for applying pressure.

Additional objects, advantages, embodiments, and novel features of the invention will be set forth in part in the description that follows, and in part will become apparent to those skilled in the art upon examination of the following or may be learned by practice of the invention.

BRIEF DESCRIPTION OF THE DRAWINGS

The invention will be more readily understood through the following detailed description, with reference to the accompanying drawings, in which:

In FIGS. 1–5, portions of the invention hidden from view are illustrated with dashed lines. Furthermore, the arrowhead in FIG. 1 is shown solely to illustrate where arrowheads are to be attached to the present invention.

DESCRIPTION OF THE PREFERRED EMBODIMENT

Figure 1:
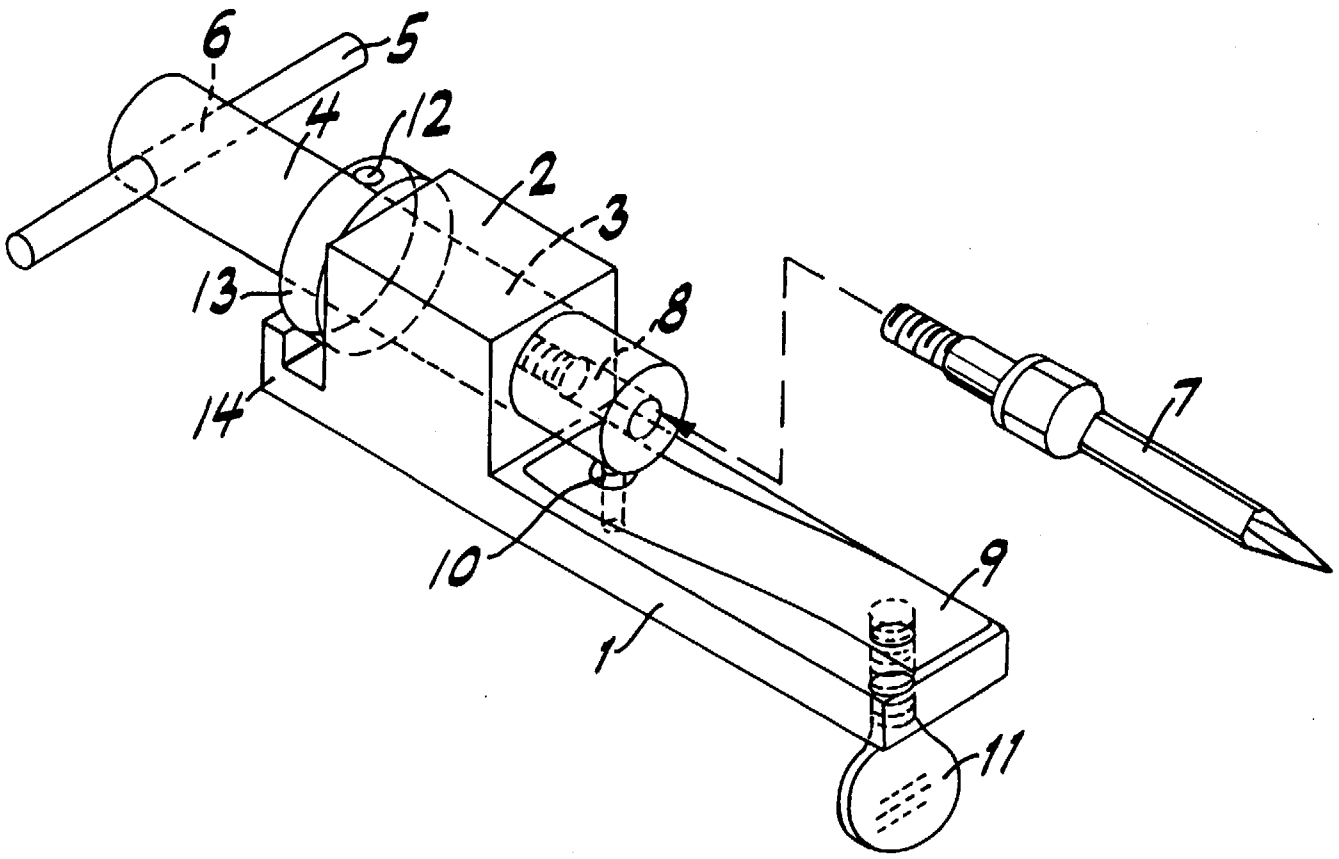
FIG. 1 is a perspective view of the present invention.
Figure 2:
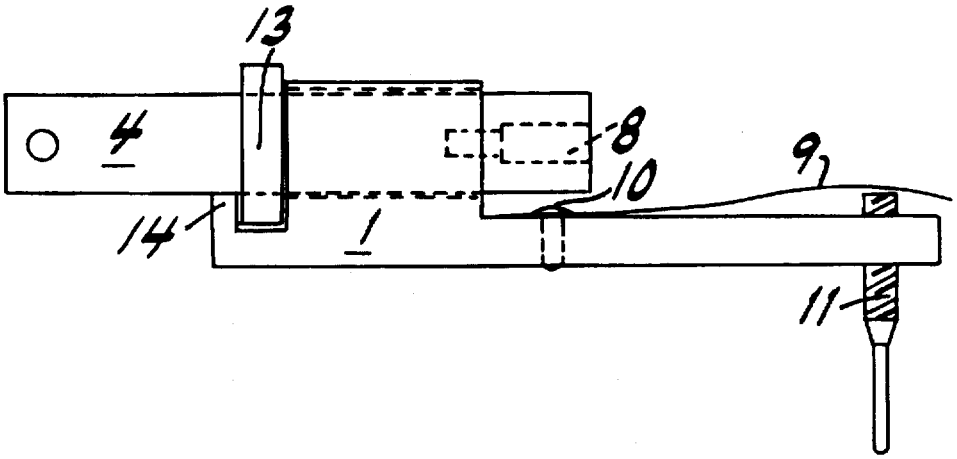
FIG. 2 is a side view of the present invention.
Figure 3:
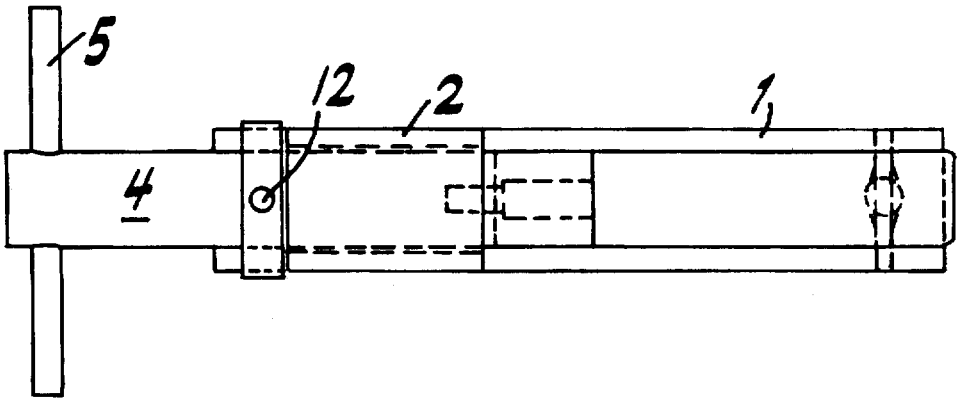
FIG. 3 is a top view of the present invention.
Figure 4:
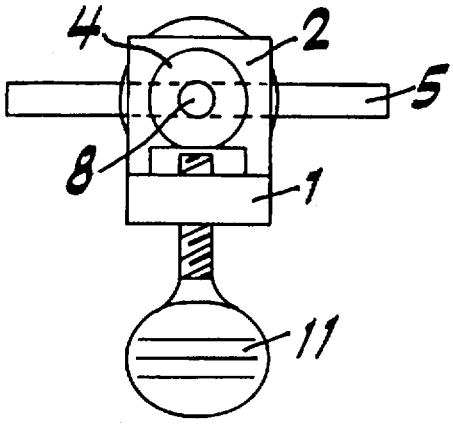
FIG. 4 is front view of the present invention.
Figure 5:
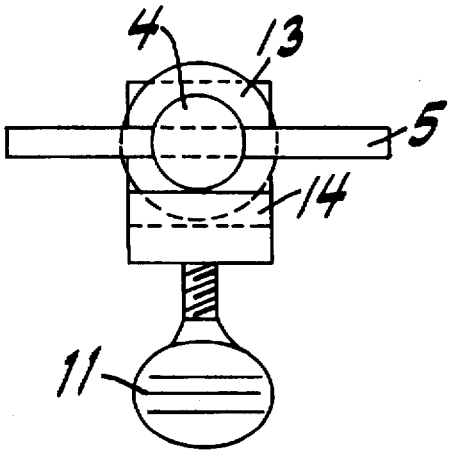
FIG. 5 is a rear view of the present invention.

The present invention is an apparatus and method for straightening arrowheads. The structure includes a base 1, to which a shaft housing 2 is attached. In the preferred embodiment of the invention, the base 1 and the shaft housing 2 are one integral unit, which is preferably constructed out of aluminum. The base 1 and the shaft housing 2, however, may be separate pieces.

A shaft aperture 3 extends through the length of the shaft housing 2. A rotatable shaft 4 extends through the shaft aperture 3. The shaft aperture 3 is of a sufficient diameter to closely engage the rotatable shaft 4, but still allow the rotatable shaft 4 to rotate easily when force is applied to a shaft handle 5. In the preferred embodiment of the invention, the diameter of the shaft aperture 3 is approximately 0.001 inches larger than the diameter of the rotatable shaft 4.

In an alternative embodiment of the invention, the shaft housing 2 may include one or more loops attached to the base 1. The loops would thereby define a shaft aperture 3 through which a rotatable shaft 4 would pass. Alternate means for supporting the rotatable shaft 4 might also include configuring the base 1 so that the shaft aperture 3 passes through the base 1.

The rotatable shaft 4 has a handle end and a cavitied end. The handle end of the rotatable shaft 4 is that end to which the shaft handle 5 is attached. A shaft handle hole 6 snugly engages the shaft handle 5, thereby attaching the shaft handle 5 to the rotatable shaft 4.

The cavitied end of the rotatable shaft 4 is that end to which an arrowhead 7 is attached. The cavitied end of the rotatable shaft 4 includes an arrowhead attachment cavity 8 designed so that an arrowhead 7 in need of straightening may be readily attached to the rotatable shaft 4. In the preferred embodiment of the invention, the arrowhead attachment cavity 8 is constructed by drilling and tapping to a depth of 1.25 inches an 8/32 inch threaded hole. A 0.204-diameter hole is then counter bored to a depth of 0.415 inches. Such a configuration is used to accommodate standard arrowhead attachment ends and thereby allow the rotatable shaft 4 to be attached easily to most arrowheads in existence.

Other threaded holes may be used for arrowheads having other configurations. Furthermore, one could construct the rotatable shaft 4 with multiple arrowhead attachment cavities 8, either as additional attachable sections of the rotatable shaft 4, or by drilling an arrowhead attachment cavity 8 into each end of the rotatable shaft 4.

The preferred method of attaching the arrowhead 7 to the rotatable shaft 4 is to attach the attachment end of the arrowhead 7 to the arrowhead attachment cavity 8 of the rotatable shaft 4. Alternate means for securing an arrowhead 7 to the rotatable shaft 4, however, certainly do exist. Specifically, one could attach an arrowhead 7 to the rotatable shaft 4 with clamps, adhesives, solder, screws, magnets, or other mechanical or electromagnetic means.

The apparatus for straightening arrowheads also includes a pressure band 9, which is attached at one end to the base 1. In the preferred embodiment of the invention, the pressure band 9 is a rectangular piece of stainless steel, which is attached to the base 1 with a steel rivet 10. When a pressure screw 11 is extended vertically through the base 1 toward the arrowhead 7, pressure is applied to the underside of the pressure band 9 and the pressure is thus transferred to the high side of the tip end of the arrowhead 7, provided the high side of the tip end of the arrowhead 7 is positioned directly above the pressure screw 11.

The effect of the pressure band 9 is to evenly distribute the pressure applied by the pressure screw 11 over a greater portion of the arrowhead 7 than would be if the pressure screw 11 came in direct contact with the arrowhead 7. Furthermore, interposing a pressure band 9 between the pressure screw 11 and the arrowhead 7 decreases the risk that the pressure screw 11 may unevenly contact the arrowhead 7 or that the pressure screw 11 may lose contact completely with the arrowhead 7 when the pressure screw 11 is being extended toward the arrowhead 7. In the preferred embodiment of the invention, the pressure screw 11 is a thumbscrew made of steel.

Alternate means for applying pressure to the high side of the tip end of the arrowhead 7 exist. In particular, one could apply pressure to the arrowhead 7 by pushing the tip end of the arrowhead 7 up with a lever or a wedge, by pulling the tip end of the arrowhead 7 up with a string, cord, wire, or chain, or by securing the tip end to an object not attached to the present apparatus and then moving the apparatus in the required direction to apply the requisite pressure to the tip end of the arrowhead 7.

The apparatus of this invention functions most effectively when the high side of the tip end of the arrowhead 7 to be straightened is positioned directly above the pressure screw 11. Because lengths of arrowheads 7 vary greatly, it is desirable that the horizontal distance between the cavitied end of the rotatable shaft 4 and the pressure screw 11 not be permanently fixed. Thus, the rotatable shaft 4 of the present invention is laterally moveable through the shaft aperture 3.

To adjust the horizontal distance between the cavitied end of the rotatable shaft 4 and the pressure screw 11 (and therefore accommodate arrowheads 7 of varying lengths), it is first necessary to loosen the set screw 12 that secures the lock ring 13 to the rotatable shaft 4. When the lock ring 13 is not secured to the rotatable shaft 4, the rotatable shaft 4 is free to move laterally through the lock ring 13 and the shaft aperture 3. When the lock ring 13 is securely attached to the rotatable shaft 4 with the set screw 12, the rotatable shaft 4 is locked into a fixed lateral position because the lower end of the lock ring 13 is not laterally moveable; the lock ring 13 is bounded on both sides by fixed objects. For example, the rotatable shaft 4 is prevented from being extended toward the pressure screw 11 (thereby decreasing the horizontal distance between the cavitied end of the rotatable shaft 4 and the pressure screw 11) because when one attempts to laterally move the rotatable shaft 4 while the lock ring 13 is secured to the rotatable shaft 4, the lock ring 13 contacts the shaft housing 2. Likewise, the rotatable shaft 4 is prevented from being withdrawn from the pressure screw 11 (thereby increasing the horizontal distance between the cavitied end of the rotatable shaft 4 and the pressure screw 11) because when one attempts to laterally move the rotatable shaft 4 while the lock ring 13 is secured to the rotatable shaft 4, the lock ring 13 contacts the rear lip 14 of the base 1. In the preferred embodiment of the invention, the lock ring 13 is constructed of steel and the set screw 12 is an "Allen" type screw.

As it is an object of the present invention that the apparatus for straightening arrowheads be easily used by archers "in the field," the overall length of the preferred embodiment of the invention is less than six inches. Furthermore, the preferred embodiment of the present invention weighs less than one pound. Thus, the preferred embodiment of the present invention is easily transportable.

In operation of the present invention, any blades on the arrowhead 7 are removed (if possible) or retracted. The arrowhead 7 is then secured to the end of the rotatable shaft 4 and the high side of the tip end of the arrowhead 7 is determined. The position of the rotatable shaft 4 is then adjusted so that the high side of the tip end of the arrowhead 7 is in the path of a means for applying pressure to the high side of the tip end of the arrowhead 7. An example of a means for applying pressure includes a pressure screw 11, used alone or in combination with a means for evenly distributing the pressure, such as a pressure band 9.

After the arrowhead 7 is properly positioned, pressure is applied to the high side of the tip end of the arrowhead 7. The preferred means for applying pressure to the high side of the tip end of the arrowhead 7 is to extend a pressure screw 11 vertically through the base 1 toward the arrowhead 7. As pressure is applied to the arrowhead 7, it is preferable, but not necessary, that the rotatable shaft 4 be rotated to ensure that pressure is evenly applied to the high side of the tip end of the arrowhead 7. An alternate way to ensure that pressure is properly applied to the high side of the tip end of the arrowhead 7 is to apply pressure to the arrowhead 7, redetermine the high side of the tip end of the arrowhead 7, rotate the rotatable shaft 4 to reposition the high side of the tip end of the arrowhead 7 over the means for applying pressure, and repeat the process.

After one or more applications of pressure to the high side of the tip end of the arrowhead 7, the arrowhead 7 should be checked to ensure that the arrowhead 7 is sufficiently straight for use in the desired archery activity. If the arrowhead 7 is still bent, the high side of the tip end of the arrowhead 7 should be redetermined and the process of applying pressure to the arrowhead 7 repeated. After the arrowhead 7 has been straightened, the now-straight arrowhead 7 can be removed from the rotatable shaft 4 and then be used (or be kept for later use) in the desired archery activity.

Still other objects and advantages of the present invention will become readily apparent to those skilled in this art from the above-recited detailed description, wherein only the preferred embodiment of the invention has been shown and described. The description of the preferred embodiment is simply by way of illustration of the best mode contemplated for carrying out the invention. As will be realized, the invention is capable of other and different embodiments, and its several details are capable of modification in various respects, all without departing from the invention. For example, the apparatus and method for straightening arrowheads can also be effectively used to straighten crossbow bolt tips or other elongated metal (or other easily deformable) tips. Accordingly, the drawings and descriptions are to be regarded as illustrative in nature, and not as restrictive.

I claim:

1. An apparatus for straightening an arrowhead, wherein the arrowhead has a tip end and an attachment end, and wherein the arrowhead in need of straightening has a high side of the tip end, comprising:

a. a base;

b. a shaft housing attached to the base, said shaft housing having an aperture therein;

c. a rotatable shaft, said rotatable shaft passing through said aperture in said shaft housing and having a cavitied end, said cavitied end having an arrowhead attachment cavity; and d. a pressure screw for applying pressure to the high side of the tip end of the arrowhead, said pressure screw being attached to the base.

2. An apparatus as recited in claim 1, further comprising:

a pressure band interposed between said pressure screw and the high side of the tip end of the arrowhead.

3. An apparatus as recited in claim 2, wherein said pressure band comprises a strip of metal.

4. An apparatus as recited in claim 3, wherein one end of said pressure band is connected to said base.

5. An apparatus as recited in claim 1, wherein said rotatable shaft is laterally moveable through the aperture in said shaft housing.

6. An apparatus as recited in claim 1, further comprising:

a lock ring connected to, and concentrically aligned with, said rotatable shaft, whereby said lock ring restricts the lateral mobility of said rotatable shaft when said lock ring is secured to said rotatable shaft.

7. An apparatus as recited in claim 6, wherein said lock ring is secured to said rotatable shaft with a set screw.

8. An apparatus for straightening an arrowhead, wherein the arrowhead has a tip end and an attachment end, and wherein the arrowhead in need of straightening has a high side of the tip end, comprising:

a. a base;

b. a rotatable shaft, said rotatable shaft having an arrowhead attachment end;

c. means for supporting said rotatable shaft, said means being connected to said base;

d. means for securing an arrowhead to said arrowhead attachment end of said rotatable shaft; and e. means for applying pressure to the high side of the tip end of the arrowhead.

9. An apparatus as recited in claim 8, further comprising:

means for positioning said rotatable shaft so that the high side of the tip end of the arrowhead is in the path of said pressure applying means.

10. An apparatus as recited in claim 8, further comprising:

means for rotating said rotatable shaft.

11. An apparatus as recited in claim 8, further comprising:

means for restricting the lateral mobility of said rotatable shaft.

12. An apparatus as recited in claim 8, further comprising:

means for evenly distributing over a portion of the arrowhead the pressure applied by said pressure pressure applying means.

13. A method for straightening an arrowhead, wherein the arrowhead has a tip end and an attachment end, and wherein the arrowhead in need of straightening has a high side of the tip end, comprising the steps of:

a. securing an arrowhead to an end of a rotatable shaft;

b. determining the high side of the tip end of the arrowhead;

c. adjusting the position of the rotatable shaft so that the high side of the tip end of the arrowhead is in the path of means for applying pressure to the high side of the tip end of the arrowhead; and d. applying pressure to the high side of the tip end of the arrowhead.

14. A method as described in claim 13, further comprising the step of:

rotating the rotatable shaft.

15. A method as described in claim 13, further comprising the step of:

rotating the rotatable shaft while applying pressure to the high side of the tip end of the arrowhead.

16. A method as described in claim 13, further comprising the step of:

removing the blades of the arrowhead.

17. A method as described in claim 13, further comprising the step of:

retracting the blades of the arrowhead.

18. A method as described in claim 13, further comprising the step of:

interposing a pressure band between the high side of the tip end of the arrowhead and the means for applying pressure to the high side of the tip end of the arrowhead.

* * * * *